US012226020B2

(12) United States Patent
Shi

(10) Patent No.: US 12,226,020 B2
(45) Date of Patent: Feb. 18, 2025

(54) INFLATABLE BED

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/754,311

(22) Filed: Jun. 26, 2024

(65) Prior Publication Data

US 2024/0341494 A1 Oct. 17, 2024

Related U.S. Application Data

(63) Continuation-in-part of application No. 18/309,305, filed on Apr. 28, 2023, now abandoned.

(30) Foreign Application Priority Data

Mar. 13, 2023 (CN) ..... 202320479535.6

(51) Int. Cl.
*A47C 27/08* (2006.01)

(52) U.S. Cl.
CPC ..... *A47C 27/081* (2013.01); *A47C 27/087* (2013.01)

(58) Field of Classification Search
CPC ... A47C 27/081; A47C 27/087; A47C 27/088; A47C 27/14
See application file for complete search history.

(56) References Cited

U.S. PATENT DOCUMENTS 4,037,591 A * 7/1977 Sarno ..... A61H 7/001 5/699
5,329,656 A * 7/1994 Leggett ..... A47C 27/18 5/709
9,254,047 B1 2/2016 Schermel et al.
(Continued)

FOREIGN PATENT DOCUMENTS

CN 2605784 Y 3/2004
CN 1736293 B * 6/2011 ..... A47C 17/32
(Continued)

OTHER PUBLICATIONS

Non-Final Office Action received in corresponding U.S. Appl. No. 18/309,305, dated Sep. 25, 2023, 11 pages.
(Continued)

*Primary Examiner* — Eric J Kurilla
(74) *Attorney, Agent, or Firm* — Cooper Legal Group, LLC

(57) ABSTRACT

The inflatable bed includes a top wall, an outer peripheral sheet, a bottom wall and an inner peripheral sheet, the top and bottom walls are arranged oppositely and fixed to the outer peripheral sheet; the inner peripheral sheet is provided with a plurality of through holes arranged at intervals in a circumferential direction of the inner peripheral sheet; the inner peripheral sheet has a first annular edge and a second annular edge that are arranged oppositely, the first annular edge is fixed to the top wall, the second annular edge is fixed to the bottom wall, both areas enclosed by the first and second annular edges are smaller than the area enclosed by the outer peripheral sheet; the inner peripheral sheet is fixedly connected with the outer peripheral sheet to form an annular connecting portion, which is located between the first annular edge and the second annular edge.

17 Claims, 3 Drawing Sheets

(56) References Cited

U.S. PATENT DOCUMENTS

| | | | | |
|---|---|---|---|---|
| 10,687,633 | B2 | 6/2020 | Liu | |
| 10,945,533 | B1 | 3/2021 | Shi | |
| 11,419,431 | B2 | 8/2022 | Li | |
| 11,969,098 | B1 * | 4/2024 | Shi | A47C 27/087 |
| 2006/0265810 | A1 * | 11/2006 | Wu | A47C 27/081 5/712 |
| 2007/0283499 | A1 * | 12/2007 | Lin | A47C 27/081 5/713 |
| 2008/0105366 | A1 | 5/2008 | Wang | |
| 2012/0079662 | A1 * | 4/2012 | Dzioba | A47C 27/10 5/713 |
| 2015/0335164 | A1 | 11/2015 | Liu | |
| 2020/0100598 | A1 * | 4/2020 | Huang | A47C 27/087 |
| 2021/0259434 | A1 | 8/2021 | Wang | |
| 2022/0346564 | A1 | 11/2022 | Huang | |
| 2023/0132601 | A1 | 5/2023 | Huang | |

FOREIGN PATENT DOCUMENTS

| | | | | |
|---|---|---|---|---|
| CN | 207784763 | U | | 8/2018 |
| CN | 209202537 | U | * | 8/2019 |
| CN | 110680114 | A | | 1/2020 |
| CN | 111000399 | A | | 4/2020 |
| CN | 111265060 | A | | 6/2020 |
| CN | 218500349 | U | | 2/2023 |
| DE | 202007008326 | U1 | | 9/2007 |

OTHER PUBLICATIONS

Final Office Action received in corresponding U.S. Appl. No. 18/309,305, dated Jan. 8, 2024, 13 pages.

Advisory Action received in corresponding U.S. Appl. No. 18/309,305, dated Mar. 21, 2024, 3 pages.

* cited by examiner

INFLATABLE BED

CROSS-REFERENCE TO RELATED APPLICATIONS

The present application is a continuation-in-part of U.S. application Ser. No. 18/309,305, filed on Apr. 28, 2023, which is based on and claims the priority benefits of China application No. 202320479535.6, filed on Mar. 13, 2023. The entireties of U.S. application Ser. No. 18/309,305 and China application No. 202320479535.6 are hereby incorporated by reference herein and made a part of this specification.

TECHNICAL FIELD

The present disclosure relates to the field of inflatable products, in particular to an inflatable bed.

BACKGROUND ART

In the existing multi-chamber inflatable bed is generally pulled by the annular pulling sheet of the rectangular sheet, and the top wall and the bottom wall each need to be separately provided with one diagonal pulling sheet, wherein one diagonal pulling sheet is fixedly connected with the top wall and surrounding wall and another annular pulling sheet is fixedly connected with the bottom wall and the surrounding wall, which structure is complex, consumables is more, welding requires more steps, the efficiency is low, and the cost is high. Moreover some inflatable beds use multiple independent rectangular sheets to pull the top wall and the surrounding wall, that is, multiple rectangular sheets are distributed around the top wall, such that the structure is more complicated, the manufacturing process is cumbersome, the efficiency is low, and the cost is high.

SUMMARY

The purpose of the present disclosure is to provide an inflatable bed, which has a simplified structure, improved manufacturing efficiency and reduced manufacturing cost.

The embodiments of the present disclosure are achieved as follow.

The present disclosure provides an inflatable bed, including: a top wall, an outer peripheral sheet, a bottom wall and an inner peripheral sheet, wherein the top wall and the bottom wall are arranged oppositely and are all fixedly connected with the outer peripheral sheet; the inner peripheral sheet is provided with a plurality of through holes, and the plurality of through holes are arranged at intervals in the circumferential direction of the inner peripheral sheet; the inner peripheral sheet has oppositely arranged first annular edge and second annular edge, the first annular edge is fixedly connected to the top wall, the second annular edge is fixedly connected to the bottom wall, and the area formed by the first annular edge and the area formed by the second annular edge are both smaller than the area formed by the outer peripheral sheet; and the inner peripheral sheet is fixedly connected to the outer peripheral sheet to form an annular connecting portion, wherein the annular connecting portion is located between the first annular edge and the second annular edge.

In an optional embodiment, the inner peripheral sheet includes a plurality of cut pieces, each of which has a first side edge, a second side edge, a third side edge and a fourth side edge connected end-to-end in sequence, wherein the first side edge is opposite to the third side edge, and the second side edge is opposite to the fourth side edge. A first notch is provided on the first side edge, a second notch is provided on the third side edge, the plurality of cut pieces are arranged in a ring, the first side edge and the third side edge of the adjacent cut pieces are fixedly connected to each other, and the first notch and the second notch at the joint are cooperated to form the through hole; and the second side edges of the plurality of cut pieces cooperate to form the first annular edge, and the fourth side edges of the plurality of cut pieces cooperate to form the second annular edge.

In an optional embodiment, the cut piece includes two sub-pieces arranged in a folded symmetry, and the folding symmetry line of the cut piece is located between the second side edge and the fourth side edge and is parallel to the second side edge and the fourth side edge; and the length of the second side edge and the length of the fourth side edge are both less than the length of the folding symmetry line located on the cut piece.

In an optional embodiment, the annular connecting portion is configured as a folded symmetrical structure, and the folding symmetry line of the annular connecting portion coincides with the folding symmetry line of the cut piece.

In an optional embodiment, at least one of the first notch and the second notch is configured as an arc-shaped notch.

In an optional embodiment, the annular connecting portion is configured as a polygon.

In an optional embodiment, the annular connecting portion includes a first long side, a first short side, a second long side and a second short side connected end-to-end in sequence, wherein the first long side and the second long side are arranged oppositely and are parallel to the plane defined by the first annular edge; and the first short side and the second short side both are arc-shaped sides, and the inner concave surface of the first short side is arranged oppositely to the inner concave surface of the second short side.

In an optional embodiment, the outer peripheral sheet is fixed to the top wall and the bottom wall through a heat welding.

Optionally, the inner peripheral sheet is fixed to the top wall and the bottom wall through a heat welding.

Optionally, the inner peripheral sheet is fixed to the outer peripheral sheet through a heat welding.

In an optional embodiment, the inflatable bed further includes a pull strap, the pull strap is located in the area formed by the inner peripheral sheet, and the two ends of the pull strap are respectively fixedly connected to the top wall and the bottom wall.

In an optional embodiment, the pull strap is a column-shaped pull strap or a plate-shaped pull strap.

In an optional embodiment, the inner peripheral sheet is further configured with a plurality of air vents, and the plurality of air vents and the plurality of through holes are arranged at intervals.

In an optional embodiment, an upper surface of the top wall is further provided with an anti-slip texture.

In an optional embodiment, an inner side of the top wall is provided with a thermal insulation layer.

In an optional embodiment, the thermal insulation layer is provided with a plurality of massage bumps.

In an optional embodiment, an outer side of the bottom wall is provided with an anti-slip pad.

In an optional embodiment, the outer peripheral sheet is provided with a plurality of connection straps, a first end of each of the plurality of connection straps is fixedly connected to the outer peripheral sheet, and a second end of each of the plurality of connection straps is provided with a connection buckle.

To sum up, the inflatable bed provided by this embodiment has at least one annular pulling sheet removed compare to the prior art and, that is, reduces at least one component, by setting the inner peripheral sheet and directly using the inner peripheral sheet to fixedly connected to the top wall, bottom wall and outer peripheral sheet at the same time, such that the structure is simplified and the cost is saved. At the same time, since one component is reduced, the processing steps can be reduced during processing and manufacturing, thereby improving processing efficiency and greatly reducing processing and manufacturing costs. After the inflatable bed is prepared, the inner peripheral sheet is fixedly connected to the top wall to form the upper tension line, the inner peripheral sheet is fixedly connected to the bottom wall to form the lower tension line, and the middle part of the inner peripheral sheet is connected with the middle part of the outer peripheral sheet to form an annular connecting portion, such that the upper tension line and the annular connecting portion form an upper triangular tension structure, and the lower tension line and the annular connecting portion form a lower triangular tension structure. As a result, the outer peripheral sheet is limited by two triangular tension structures inverted from each other at the same time, such that the outer peripheral sheet will not collapse outwards, and the overall structure of the inflatable bed is stable, reliable and highly comfortable.

BRIEF DESCRIPTION OF THE DRAWINGS

In order to more clearly illustrate the technical solutions of the embodiments of the present disclosure, the drawings used in the embodiments will be briefly introduced below. It should be understood that the following drawings only show some embodiments of the present disclosure, so they should not be regarded as a limitation on the scope. For those ordinarily skilled in the art, other related drawings can also be obtained according to these drawings without inventive effort.

DETAILED DESCRIPTION

Figure 1:
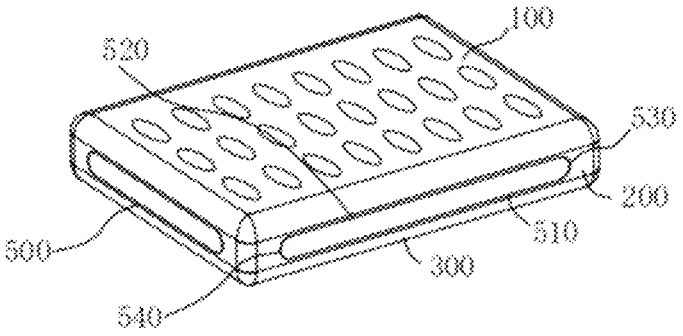
FIG. 1 is a schematic structural view of an inflatable bed of the embodiment 1 of the present disclosure.

In order to make the purpose, technical solutions and advantages of the embodiments of the present disclosure clearer, the technical solutions in the embodiments of the present disclosure will be clarified clearly and completely below in conjunction with the drawings of the embodiments of the present disclosure. Obviously, the described embodiments are a part of the embodiments of the present disclosure, rather than all the embodiments. The components of the embodiments of the present disclosure generally described and illustrated in the drawings herein may be arranged and designed in a variety of different configurations.

Therefore, the following detailed description of the embodiments of the present disclosure provided in the drawings is not intended to limit the scope of the claimed disclosure, but merely represents selected embodiments of the present disclosure. Based on the embodiments of the present disclosure, all other embodiments obtained by persons of ordinary skill in the art without inventive efforts belong to the scope of protection of the present disclosure.

It should be noted that similar numerals and letters denote similar items in the following drawings, therefore, once an item is defined in one figure, further definition and explanation in subsequent drawings are not required.

In the description of the present disclosure, it should be noted that the orientation or positional relationship indicated by terms “center”, “up”, “low”, “left”, “right”, “vertical”, “horizontal”, “inner”, “outer” is based on the orientation or positional relationship shown in the drawings, or the orientation or positional relationship where the product of the present disclosure is usually placed when being used; and it is only for the convenience of describing the present disclosure and simplifying the description, rather than indicating or implying that the devices or elements referred must be in a particular orientation or be constructed and operated in a particular orientation, therefore it should not be construed as a limitation of the present disclosure. In addition, the terms “first”, “second”, “third”, etc. are only used for distinguishing descriptions, and should not be construed as indicating or implying relative importance.

Furthermore, the terms “horizontal”, “vertical” and the like do not imply that a component is absolutely horizontal or overhanging, but may be slightly inclined. For example, “horizontal” only means that its direction is more horizontal than “vertical”, and it does not mean that the structure must be completely horizontal, but can be slightly inclined.

In the description of the present disclosure, it should also be noted that, unless otherwise clearly specified and limited, the terms “provide”, “install”, “link” and “connect” should be understood in a broad sense, for example, it can be a fixed connection, a detachable connection or an integral connection; it can be a mechanical connection or an electrical connection; and it can be a direct connection or an indirect connection through an intermediary, or it can be the internal communication between two components. Those of ordinary skill in the art can understand the specific meanings of the above terms in the present disclosure in specific situations.

At present, in order to improve the stability of the inflatable bed, pulling sheets are generally arranged in the bed body. The technical solution of setting two annular pulling sheets in the bed body in the prior art is taken as an example for illustration. One of two annular pulling sheets is fixedly connected with the top surface and the surrounding surface of the bed body at the same time, and the other one of the two annular pulling sheets is fixedly connected with the bottom surface and the surrounding surface of the bed body at the same time, and the two annular pulling sheets have a distance in the thickness direction of the bed body. As a result, each annular pulling sheet needs to be fixedly connected to the bed body twice, so that four times of fixed connection are required in total, the manufacturing steps are cumbersome, the efficiency is low, and the cost is high. Simultaneously, the two annular pulling sheets are of independent structure, and these two cannot cooperate with each other to realize the fixing of the bed body, and the stability of the bed body is poor.

In view of this, the designer provides an inflatable bed, which can not only simplify the manufacturing steps, improve efficiency and reduce costs, but also improve the stability of the bed body and improve user experience.

Embodiment 1

Figure 2:
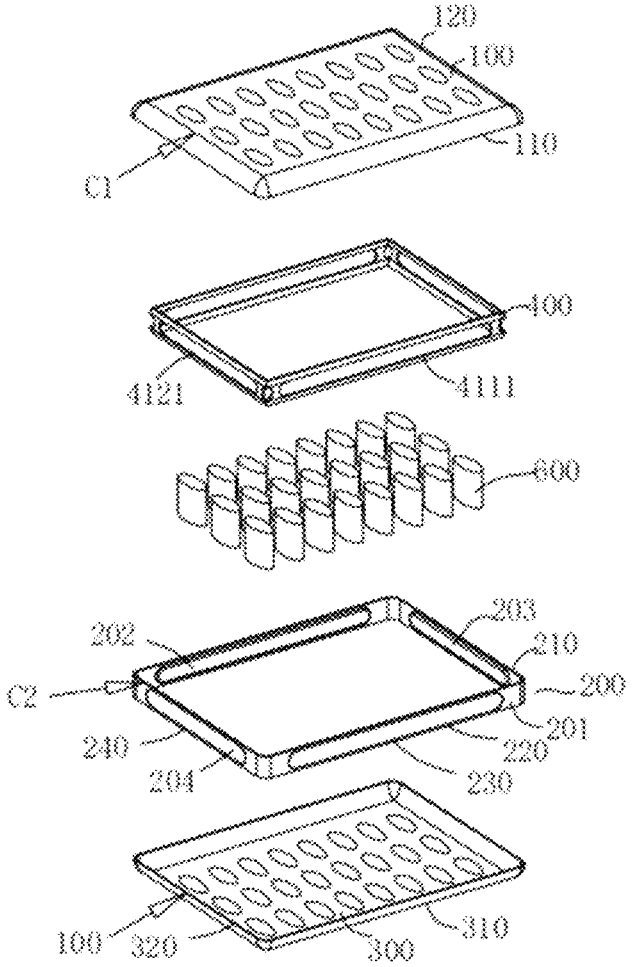
FIG. 2 is a schematic view of decomposition structure of an inflatable bed of the embodiment 1 of the present disclosure.

Referring to FIG. 1 and FIG. 2, in this embodiment, the inflatable bed includes a top wall 100, an outer peripheral sheet 200, a bottom wall 300 and an inner peripheral sheet 400. Wherein the top wall 100 and the bottom wall 300 are set oppositely and both are fixedly connected with the outer peripheral sheet 200. The inner peripheral sheet 400 is provided with a plurality of through holes 401, and the plurality of through holes 401 are arranged at intervals on inner peripheral sheet 400 in the circumferential direction. The inner peripheral sheet 400 has the first annular edge 402 and the second annular edge 403 arranged oppositely, the first annular edge 402 is fixedly connected with the top wall 100, the second annular edge 403 is fixedly connected with the bottom wall 300, and the area enclosed by the first annular edge 402 and the area enclosed by the second annular edge 403 both are smaller than the area enclosed by the outer peripheral sheet 200. And the inner peripheral sheet 400 and outer peripheral sheet 200 are fixedly connected and form an annular connecting portion 500, and the annular connecting portion 500 is arranged between the first annular edge 402 and the second annular edge 403.

After the inflatable bed is manufactured, a central air chamber and a peripheral air chamber surrounding the central air chamber are formed, wherein the peripheral air chamber and the central air chamber communicate through a plurality of through holes 401, such that the air pressure inside the entire inflatable bed is consistent, and the stability is high. Moreover the design of the peripheral air chamber not only strengthens the strength of the edge of top wall 100 and the edge of the bottom wall 300 of the inflatable bed, but also improves the strength of the circumferential surface of the inflatable bed, such that the whole inflatable bed has stable structure and the using comfort is high. At the same time, by directly using the inner peripheral sheet 400 to be fixedly connected with the top wall 100, the bottom wall 300 and the outer peripheral sheet 200 simultaneously, and compared with the prior art, at least one annular pulling sheet can be reduced, that is, at least one component is reduced, so that the structure is simplified. Therefore, the processing steps can be reduced during processing and manufacturing, thereby improving processing efficiency and greatly reducing the cost of processing and manufacturing. After the inflatable bed is prepared, the inner peripheral sheet 400 is fixedly connected with the top wall 100 to form the upper tension line, the inner peripheral sheet 400 is fixedly connected with the bottom wall 300 to form the lower tension line, and the middle part of the inner peripheral sheet 400 and the middle part of the outer peripheral sheet 200 are connected to form the annular connecting portion 500, such that the upper tension line and the annular connecting portion 500 form an upper triangular tension structure, the lower tension line and the annular connecting portion 500 form a lower triangular tension structure. Such that the outer peripheral sheet 200 is simultaneously limited by two inverted triangular tension structures, the outer peripheral sheet 200 will not collapse outward, the overall structure of the inflatable bed is stable and reliable, and the use comfort is high.

It should be understood that the specific shape of the inflatable bed provided in this embodiment is not limited, and the following embodiments take an inflatable bed of cuboid as an example for illustration.

Referring to FIG. 2, in this embodiment, optionally, both the top wall 100 and the bottom wall 300 are of rectangular, four corners of top wall 100 and bottom wall 300 are all rounded corners, which reduces stress concentration and facilitate processing and manufacturing. The top wall 100 includes the first outer molding line 110 and the first inner molding line 120, wherein the first outer molding line 110 is the outer edge of the top wall 100, the first inner molding line 120 is annular and is located at the area enclosed by the first outer molding line 110. And the first inner molding line 120 has a similar structure with the first outer molding line 110, that is, the first inner molding line 120 can be obtained after the first outer molding line 110 is scaled down. The bottom wall 300 includes the second outer molding line 310 and the second inner molding line 320, wherein the second outer molding line 310 is the outer edge of the bottom wall 300, the second inner molding line 320 is annular and is located in the area surrounded by the second outer molding line 310. And the second inner molding line 320 and the second outer molding line 310 has a similar structure, that is, the second inner molding line 320 can be obtained by scaling down the second outer molding line 310. The perimeters of the first outer molding line 110 and the second outer molding line 310 are equal, and the perimeters of the first inner molding line 120 and the second inner molding line 320 are equal and is referred to as C1.

Referring to FIG. 2, optionally, the outer peripheral sheet 200 is a rectangular ring piece, and the outer peripheral sheet 200 has an upper molding line 210 and a lower molding line 220, wherein the upper molding line 210 and lower molding line 220 are the two annular edges of the outer peripheral sheet 200 respectively. The upper molding line 210 and the lower molding line 220 are all annular, and the upper molding line 210 and the lower molding line 220 have equal perimeters and are labeled as C2. Specifically, the outer peripheral sheet 200 includes the first long piece 201, the first short piece 203, the second long piece 202, the second short piece 204 connected end-to-end in sequence, wherein the first long piece 201 and the second long piece 202 are arranged in parallel at intervals, and the first short piece 203 and the second short piece 204 are arranged in parallel at intervals. The first long piece 201 and the second long piece 202 are both provided with the first annular molding line 230, wherein two first annular molding lines 230 are arranged directly oppositely and consistent in size and shape. The first short piece 203 and the second short piece 204 are both provided with the second annular molding line 240, and the two second annular molding lines 240 are directly opposite and consistent in size and shape. For example, the first annular molding line 230 and the second annular molding line 240 both are waist-shaped, that is, the first annular molding line 230 and the second annular molding line 240 each have two long sides and two short sides, wherein two long sides extend in the length direction of the first long piece 201 or the second long piece 202, both two short sides are semicircular, and the inner concave surfaces of the two short sides face to each other. At the same time, the first annular molding line 230 and the second annular molding line 240 are all configured as a folded symmetrical structure, wherein the fold line is parallel to the long side.

Figure 3:
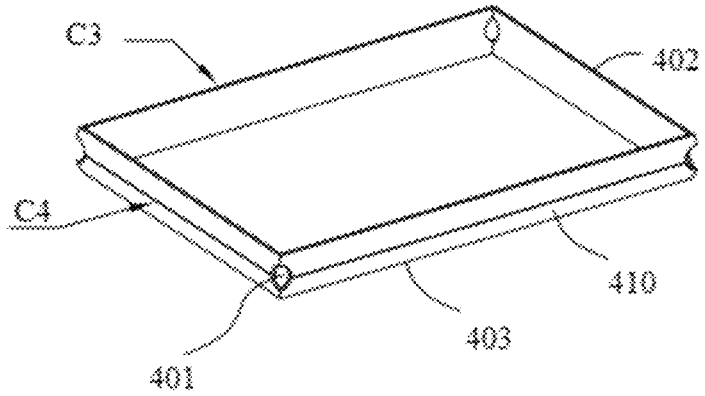
FIG. 3 is a schematic structural view of the inner peripheral sheet of the embodiment 1 of the present disclosure.
Figure 4:
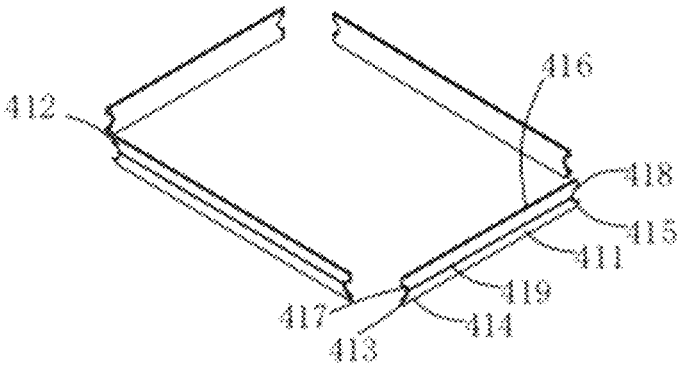
FIG. 4 is a schematic view of the decomposition structure of the inner peripheral sheet of the embodiment 1 of the present invention.
Figure 5:
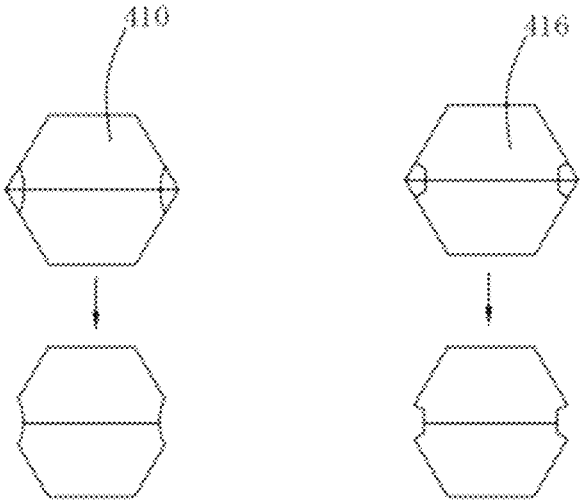
FIG. 5 is a schematic structural view of a cut piece of the embodiment 1 of the present disclosure.
Figure 6:
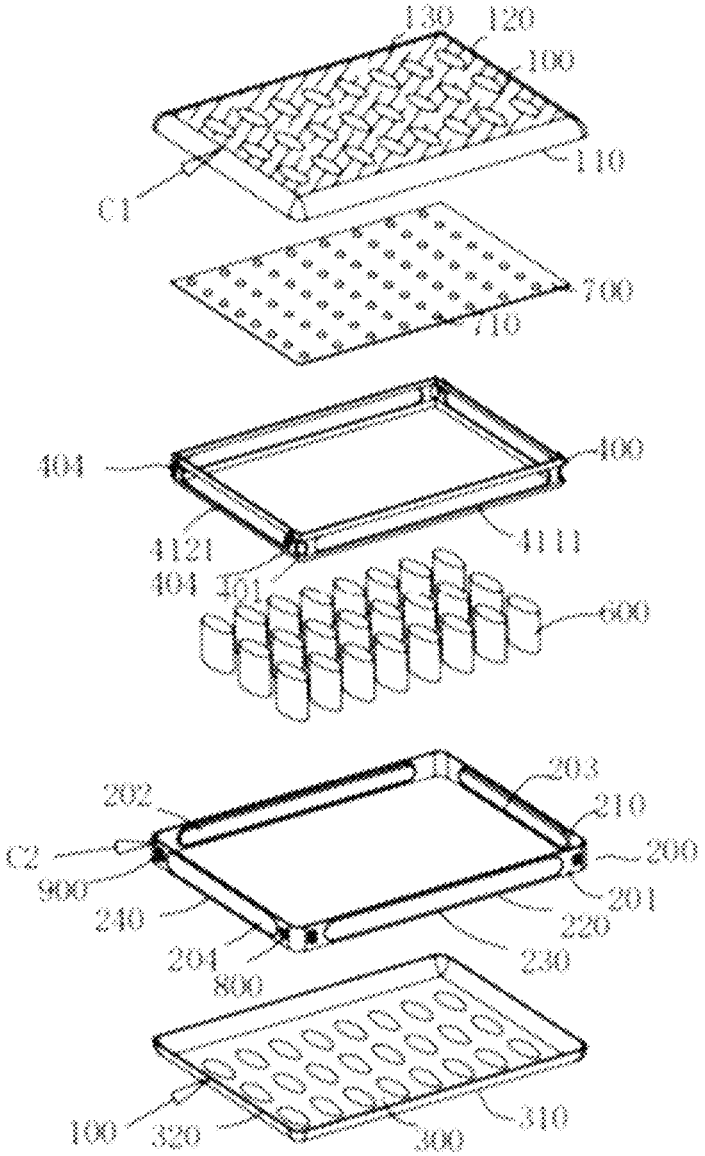
FIG. 6 is an exploded view of the inflatable bed of the embodiment 2 of the present disclosure.

Referring to FIG. 3-FIG. 5, optionally, inner peripheral sheet 400 includes a plurality of cut pieces 410, and the shape of the inner peripheral sheet 400 matches with the shape of outer peripheral sheet 200. Therefore, in this embodiment, the inner peripheral sheet 400 includes four cut pieces 410, which are connected end-to-end in sequence to form the inner peripheral sheet 400 of the rectangular ring. The four cut pieces 410 are divided into two long cut pieces 411 and two short cut pieces 412, wherein two long cut pieces 411 are arranged in pairs and oppositely, two short cut pieces 412 are arranged in pairs and oppositely, adjacent long cut pieces 411 and short cut pieces 412 are connected. It should be noted that the long cut piece 411 and the short cut piece 412 are similar in shape, and only part of the size is different. In order to avoid repetitive and cumbersome descriptions, the structure of one cut piece 410 is taken as an example for illustration.

Each cut piece 410 has the first side edge 413, second side edge 414, third side edge 415 and the fourth side edge 416 connected end-to-end in sequence, wherein the first side edge 413 and the third side edge 415 are arranged oppositely, and the second side edge 414 and the fourth side edge 416 are arranged oppositely. A first notch 417 is provided on the first side edge 413, and a second notch 418 is provided on the third side edge 415, wherein the first notch 417 and the second notch 418 are of the same shape and size, and both can be set as arc-shaped notches. When four cut pieces 410 are connected end-to-end in sequence, the first side edge 413 and the third side edge 415 of adjacent cut pieces 410 are fixedly connected with each other, wherein the first notch 417 cooperates with the second notch 418 at the joint to form a through hole 401, thus, four through holes 401 are formed on the inner peripheral sheet 400, and the positions of four through holes 401 correspond to the four corners of the outer peripheral sheet 200 respectively. The second side edges 414 of four cut pieces 410 cooperate to form the first annular edge 402, and the fourth side edges 416 of four cut pieces 410 cooperate to form the second annular edge 403.

At the same time, the cut piece 410 includes two sub-pieces arranged in folded symmetry, and the folding symmetry line of the cut piece 410 is located between the second side edge 414 and the fourth side edge 416 and parallel to the second side edge 414 and the fourth side edge 416. The length of the second side edge 414 and the length of the fourth side edge 416 are both shorter than the length of the folding symmetry line 419 of the folding symmetry line located on the cut piece 410. In this embodiment, the perimeters of the first annular edge 402 and the second annular edge 403 are equal and referred to as C3, wherein C3=C1, where C3 is the sum of the second side edges 414 of four cut pieces 410. The number of cut pieces 410 is four, and the sum of the four folding symmetry lines 419 on the four cut pieces 410 is C4, wherein C4=C2. At the same time, the long cut piece 411 is provided with a third annular molding line 4111, and the short cut piece 412 is provided with a fourth annular molding line 4121. The third annular molding line 4111 and the first annular molding line 230 are equal in the shape and the size, and the fourth annular molding line 4121 and the second annular molding line 240 are equal in the shape and the size.

In this embodiment, the cut piece 410 can be processed by punching. Firstly, the rectangular sheet is punched to form two inverted isosceles trapezoids, and the two inverted isosceles trapezoids share the lower base, which is the folding symmetry line 419 in folded symmetry. Then the parts on both sides of the two isosceles trapezoids are punched out, and a notch is formed at the punched-out part on the cut piece 410.

It should be understood that the first inner molding line 120, the second inner molding line 320, the first annular molding line 230, the second annular molding line 240, the third annular molding line 4111 and the fourth annular molding line 4121 all can be a virtual line, or can be a process line marked at a corresponding position, which plays a role in positioning and alignment during processing and manufacturing, thereby improving processing accuracy and efficiency.

In this embodiment, the inflatable bed can include the manufacturing process as follows.

For example, firstly four cut pieces 410 are prepared, and then the four cut pieces 410 are connected end-to-end in sequence, the first side edge 413 and third side edge 415 of adjacent cut pieces 410 are welded and fixed by heat-sealing, wherein the notch is not welded, and the corresponding two notches form a through hole 401. An inner peripheral sheet 400 is formed by heat-sealing four cut pieces 410.

Referring to FIG. 1 and FIG. 2, then the inner peripheral sheet 400 and outer peripheral sheet 200 are welded and fixed by heat-sealing. The third annular molding line 4111 on the inner peripheral sheet 400 is welded and fixed with the corresponding first annular molding line 230 on the outer peripheral sheet 200 by heat-sealing, to form an annular weld joint, which can be called as an annular connecting portion 500. The fourth annular molding line 4121 on the inner peripheral sheet 400 is welded and fixed with the corresponding second annular molding line 240 on the outer peripheral sheet 200 by a heat welding, to form an annular weld joint, which can be called as the annular connecting portion 500. Therefore, after the inner peripheral sheet 400 and outer peripheral sheet 200 are welded by heat-sealing, four annular connecting portions 500 are formed, wherein two of the annular connecting portions 500 are respectively located on two first long pieces 201 and are in the same shape and size, and the other two of the annular connecting portions 500 are respectively located on two second short pieces 204 and are in the same shape and size. The area enclosed by the annular connecting portions 500 located on the first long piece 201 and the second long piece 202 is larger than that enclosed by the annular connecting portions 500 located on the first short piece 203 and the second short piece 204. Additionally, each annular connecting portion 500 includes the first long side 510, the second long side 520, the first short side 530 and the second short side 540 connected end-to-end in sequence, wherein the first long side 510 and the second long side 520 are set oppositely and are parallel to the plane defined by the first annular edge 402; and the first short side 530 and the second short side 540 are both arc-shaped sides, for example, the first short side 530 and the second short side 540 are semicircular arc, wherein the inner concave surface of the first short side 530 is arranged oppositely to the inner concave surface of the second short side 540.

Then a plurality of pull straps 600 are arranged in the area enclosed by the inner peripheral sheet 400, two ends of each pull strap 600 are respectively welded with the top wall 100 and the bottom wall 300 by means of heat-sealing.

Next, the first annular edge 402 of the inner peripheral sheet 400 is welded with the first inner molding line 120 of the top wall 100 by heat-sealing, and the second annular edge 403 of the inner peripheral sheet 400 is welded with the second inner molding line 320 of the bottom wall 300 by heat-sealing; and the first outer molding line 110 of the top wall 100 is welded with the upper molding line 210 of the outer peripheral sheet 200 by a heat welding, and the second outer molding line 310 of the bottom wall 300 is welded with the lower molding line 220 of the outer peripheral sheet 200 by heat-sealing.

It should be understood that the welding sequence of the top and bottom of the inflatable bed is not limited, for example, the top can be processed first, and then the bottom, or both can be processed at the same time.

In addition, in other embodiments, when the inflatable bed is prepared, other methods other than the heat-sealing can be used for fixed connection.

It should be noted that the number of pull straps 600 is not limited, and the pull straps 600 can be column-shaped pull strap 600 or plate-shaped pull strap 600, etc.

The inflatable bed in this embodiment 1 is provided with a brand-new inner peripheral sheet 400, the inner peripheral sheet 400, the outer peripheral sheet 200, the top wall 100 and the bottom wall 300 are connected, such that the stability of overall structural of the inflatable bed is higher, which is not easy to collapse when in use and has a high degree of comfort.

Embodiment 2

The difference from embodiment 1 is the following additional scheme based on the embodiment 1.

Specifically, a plurality of air vents 404 are defined on the inner peripheral sheet 400, which and the through holes 401 are arranged at intervals. During use, the gas between the inner peripheral sheet 400 and the outer peripheral sheet 200 is discharged through the air vents and the through holes. Such a design ensures the appropriate gas balance during use of the inflatable bed, which avoids instability or discomfort caused by gas accumulation.

Furthermore, the air vent 404 is designed in a one-way valve structure, which allows the gas to be discharged between the inner peripheral sheet 400 and the outer peripheral sheet 200 while preventing external gas from entering, thereby ensuring the venting effectiveness and preventing the influence of external environment on the inside of the bed body, thereby increasing the stability and comfort of the inflatable bed.

In addition, an upper surface of the top wall 100 is further provided with anti-slip textures 130, which enhance the stability in use. By providing additional friction, these anti-slip textures 130 may reduce the possibility that users slide or lose balance on the bed, thereby improving the safety and comfort of the bed.

Furthermore, an inner side of the top wall 100 is provided with a thermal insulation layer 700, which is fixed to the top wall 100 through a heat welding, so as to reduce a loss of body heat to the outside of the bed body, thereby improving the thermal insulation performance of the bed body, and thus increasing use comfort and sleep quality.

At the same time, the thermal insulation layer 700 is provided with a plurality of massage bumps 710, which are arranged in a matrix to massage the user when he or she are lying on the inflatable bed. With the massage bumps 710 the contact surface with the body may be increased, so as to provide a more even massage experience, thereby enhancing the comfort and massage effects of the inflatable bed.

Furthermore, an outer side of the bottom wall 300 is provided with an anti-slip pad 313, which enhances the stability of the inflatable bed on the ground. By providing the additional friction and grip, the anti-slip pad 313 may reduce the movement or sliding of the bed during use, thereby increasing the safety and stability of the bed.

In addition, the outer peripheral sheet 200 is provided with a plurality of connection straps 800, an end of the connection strap 800 is fixedly connected to the outer peripheral sheet 200, and the other end thereof is provided with a connection buckle 900, so as to connect a plurality of inflatable beds together to form a larger usage space, which allows users to connect a plurality of bed bodies as required, to meet different usage needs, thereby increasing the flexibility and versatility of the inflatable bed.

The above descriptions are only preferred embodiments of the present disclosure, and are not intended to limit the present disclosure. For those skilled in the art, the present disclosure can have various modifications and changes. Any modification, equivalent replacement, improvement, etc. made within the spirit and principles of the present disclosure shall be included in the protection scope of the present disclosure.

LIST OF REFERENCE NUMERALS

100 top wall
110 first outer molding line
120 first inner molding line
130 anti-slip texture
200 outer peripheral sheet
201 first long piece
202 second long piece
203 first short piece
204 second short piece
210 upper molding line
220 lower molding line
230 first annular molding line
240 second annular molding line
300 bottom wall
310 second outer molding line
320 second inner molding line
313 anti-slip pad
400 inner peripheral sheet
401 through hole
402 first annular edge
403 second annular edge
404 air vent
410 cut piece
411 long cut piece
4111 third annular molding line
412 short cut piece
4121 fourth annular molding line
413 first side edge
414 second side edge
415 third side edge
416 fourth side edge
417 first notch
418 second notch
419 folding symmetry line
500 annular connecting portion
510 first long side
520 second long side
530 first short side
540 second short side
600 pull strap
700 thermal insulation layer
710 massage bump
800 connection strap
900 connection buckle

What is claimed is:

1. An inflatable bed, comprising a top wall, an outer peripheral sheet, a bottom wall and an inner peripheral sheet, wherein the top wall and the bottom wall are arranged opposite to each other and are each fixedly connected with the outer peripheral sheet, the inner peripheral sheet is configured with a plurality of through holes, the plurality of through holes are arranged at intervals in a circumferential direction of the inner peripheral sheet, the inner peripheral sheet has a first annular edge and a second annular edge that are arranged opposite to each other, the first annular edge is fixedly connected to the top wall, the second annular edge is fixedly connected to the bottom wall, an area formed by the first annular edge and an area formed by the second annular edge are both smaller than an area formed by the outer peripheral sheet, the inner peripheral sheet is fixedly connected with the outer peripheral sheet to form an annular connecting portion, and the annular connecting portion is located between the first annular edge and the second annular edge, wherein the inner peripheral sheet is further configured with a plurality of air vents, the plurality of air vents and the plurality of through holes are arranged at intervals, and the plurality of air vents are provided as one-way flow structures.

2. The inflatable bed according to claim 1, wherein the inner peripheral sheet comprises a plurality of cut pieces, each of the plurality of cut pieces has a first side edge, a second side edge, a third side edge and a fourth side edge which are connected end-to-end in sequence, the first side edge and the third side edge are arranged opposite to each other, the second side edge and the fourth side edge are arranged opposite to each other, a first notch is provided on the first side edge, a second notch is provided on the third side edge, the plurality of cut pieces are arranged in a ring, the first side edge and the third side edge of adjacent cut pieces of the plurality of cut pieces are fixedly connected, the first notch and the second notch at a joint cooperate to form a through hole, second side edges of the plurality of cut pieces cooperate to form the first annular edge, and fourth side edges of the plurality of cut pieces cooperate to form the second annular edge.

3. The inflatable bed according to claim 2, wherein each of the plurality of cut pieces comprises two sub-pieces arranged in a folded symmetry, a folding symmetry line of each of the plurality of cut pieces is located between the second side edge and the fourth side edge and parallel to the second side edge and the fourth side edge, and a length of the second side edge and a length of the fourth side edge are both smaller than a length of the folding symmetry line located on a corresponding one of the plurality of cut pieces.

4. The inflatable bed according to claim 3, wherein the annular connecting portion is configured as a folded symmetrical structure, wherein a folding symmetry line of the annular connecting portion coincides with the folding symmetry line of the corresponding one of the plurality of cut pieces.

5. The inflatable bed according to claim 2, wherein at least one of the first notch or the second notch is arranged as an arc-shaped notch.

6. The inflatable bed according to claim 1, wherein the annular connecting portion is configured as a polygon.

7. The inflatable bed according to claim 6, wherein the annular connecting portion comprises a first long side, a first short side, a second long side and a second short side which are connected end-to-end in sequence and parallel to a plane defined by the first annular edge, the first long side and the second long side are arranged opposite to each other and are parallel to the plane defined by the first annular edge, the first short side and the second short side both are arc-shaped sides, and an inner concave surface of the first short side is arranged opposite to an inner concave surface of the second short side.

8. The inflatable bed according to claim 1, wherein the outer peripheral sheet is fixed to the top wall and the bottom wall through a heat welding.

9. The inflatable bed according to claim 1, wherein the inner peripheral sheet is fixed to the top wall and the bottom wall through a heat welding.

10. The inflatable bed according to claim 1, wherein the inner peripheral sheet is fixed to the outer peripheral sheet through a heat welding.

11. The inflatable bed according to claim 1, wherein the inflatable bed further comprises a pull strap, the pull strap is located in an area formed by the inner peripheral sheet, and two ends of the pull strap are fixedly connected to the top wall and the bottom wall, respectively.

12. The inflatable bed according to claim 11, wherein the pull strap is a column-shaped pull strap or a plate-shaped pull strap.

13. The inflatable bed according to claim 1, wherein an upper surface of the top wall is further provided with anti-slip textures.

14. The inflatable bed according to claim 1, wherein an inner side of the top wall is provided with a thermal insulation layer.

15. The inflatable bed according to claim 14, wherein the thermal insulation layer is provided with a plurality of massage bumps.

16. The inflatable bed according to claim 1, wherein an outer side of the bottom wall is provided with an anti-slip pad.

17. The inflatable bed according to claim 1, wherein the outer peripheral sheet is provided with a plurality of connection straps, a first end of each of the plurality of connection straps is fixedly connected to the outer peripheral sheet, and a second end of each of the plurality of connection straps is provided with a connection buckle.

* * * * *